United States Patent [19]

De Masi, Jr. et al.

[11] Patent Number: 4,801,144

[45] Date of Patent: Jan. 31, 1989

[54] HOCKEY PUCK

[75] Inventors: Anthony De Masi, Jr.; John A. McMahon, 3rd, both of West Hartford, Conn.

[73] Assignee: Roll-A-Puck Limited, Simsbury, Conn.

[21] Appl. No.: 91,750

[22] Filed: Sep. 1, 1987

[51] Int. Cl.[4] ..... A63B 71/00

[52] U.S. Cl. ..... 273/128 R

[58] Field of Search ..... 273/128 R, 126 R, 126 A, 273/128 CS, 85 R, 1 B, 1 R; 29/724, 725; 384/18, 490; 308/201

[56] References Cited

U.S. PATENT DOCUMENTS

| | | | |
|---|---|---|---|
| 2,444,810 | 7/1948 | Creasy | 273/128 R |
| 3,090,109 | 5/1963 | White et al. | 29/725 |
| 3,941,381 | 3/1976 | Trbovich | 273/85 R |

FOREIGN PATENT DOCUMENTS

| | | | |
|---|---|---|---|
| 527738 | 7/1956 | Canada | 273/128 R |
| 099236 | 11/1970 | Canada | 273/128 R |
| 2838189 | 3/1980 | Fed. Rep. of Germany | 273/128 R |
| 2316985 | 2/1977 | France | 273/85 R |
| 916599 | 1/1963 | United Kingdom | 384/49 |

*Primary Examiner*—Richard C. Pinkham
*Assistant Examiner*—T. Brown
*Attorney, Agent, or Firm*—McCormick, Paulding & Huber

[57] ABSTRACT

A road hockey puck in the shape of a cylindrical body. The body is defined by a pair of mating cylindrical sections having inner and outer faces. Each inner face is provided with hemi-spherical cavities which extend through the outer face. A spherical ball is placed in each cavity such that when the mating sections are joined to form the cylindrical body a portion of each ball will extend beyond the outer surface of each section and thus provide a puck which can be propelled on each of its flat faces.

7 Claims, 1 Drawing Sheet

HOCKEY PUCK

This invention relates generally to hockey pucks for use on paved surfaces such as roads or parking lots or indoor rinks and deals more particularly with a road hockey puck having the same physical characteristics as a conventional ice hockey puck on an ice surface.

In accordance with the present invention I have duplicated the general size and shape of a conventional ice hockey puck, a road hockey puck with substantially similar weight as that of a conventional ice hockey puck. The puck has a generally cylindrical body portion. Two identical half sections define the puck body portion. These body sections are joined together and define internal cavities for receiving spherical ball elements. An important feature of the present invention is that three ball elements are provided in the preferred embodiment and each ball element has a diameter slightly greater than that of the thickness or height of the puck. More particularly a conventional hockey puck has approximately a one inch thickness or height in the axial direction, and this dimension is duplicated in the road hockey puck disclosed herein. However, the spherical ball elements have a diameter of approximately one and one-eighth inch so that diametrically opposed portions of each ball project through openings provided for them in the outer surfaces of the road hockey puck body portion.

DETAILED DESCRIPTION

Figure 1:
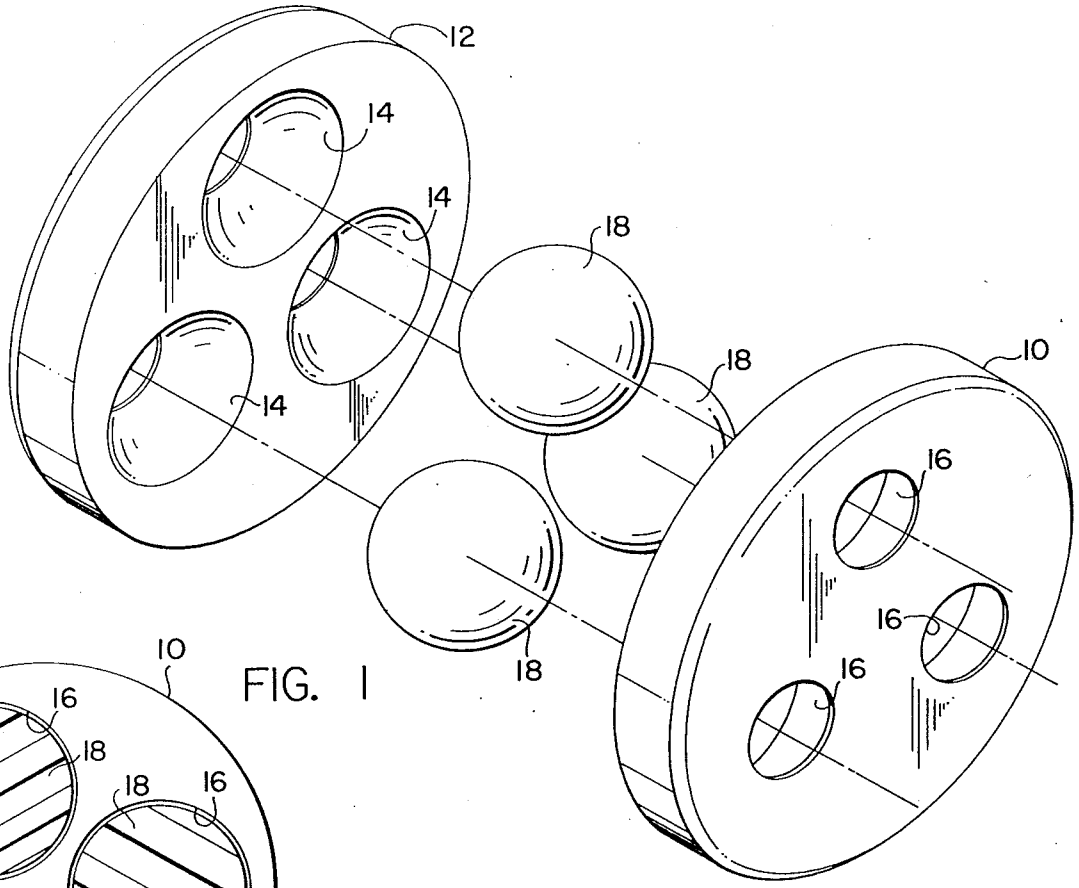
FIG. 1 is a perspective view showing a first embodiment of my invention, the various parts being illustrated in exploded relationship.
Figure 5:
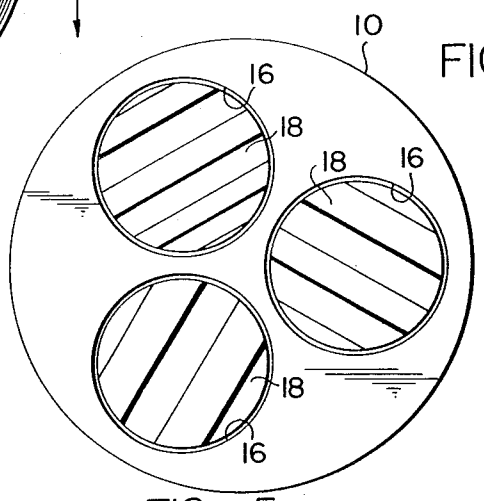
FIG. 5 is a sectional view taken generally on the line 5—5 of FIG. 4.
Figure 4:
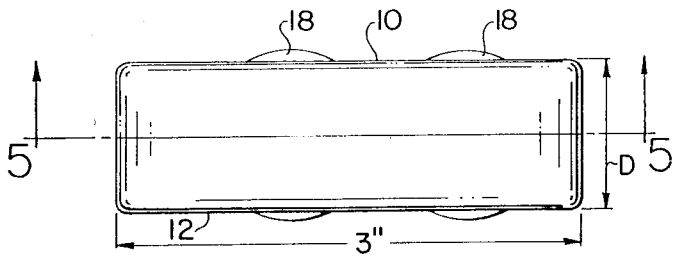
FIG. 4 is a side elevational view of the puck illustrated in FIG. 1.

Turning now to the drawings in greater detail, FIGS. 1, 4 and 5 illustrate a preferred embodiment of the present invention wherein the puck body sections are secured together by a sonic welding process applied to the half sections generally between the cavity defining portions thereof.

Figure 2:
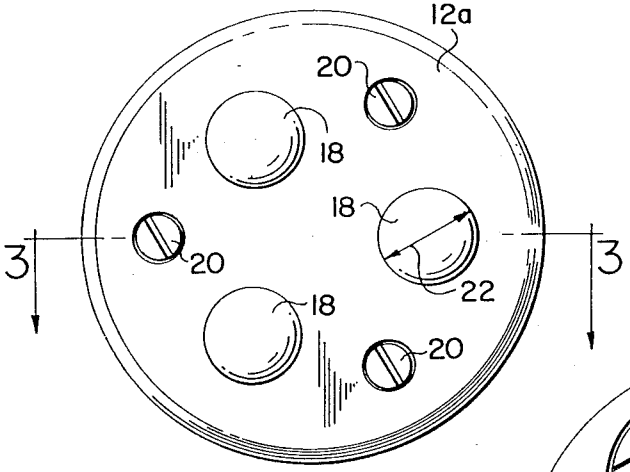
FIG. 2 is a top plan view of an assembled road hockey puck illustrating fastener elements for securing the body half sections in assembled relationship in an alternative embodiment.
Figure 3:
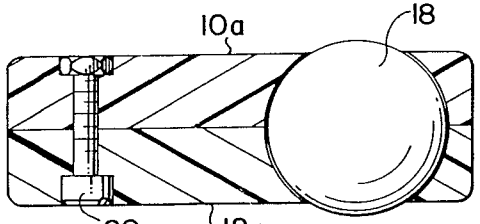
FIG. 3 is a sectional view taken generally on the line 3—3 of FIG. 2.

FIGS. 2 and 3 illustrate an alternative embodiment wherein three fasteners are provided to secure the half sections in assembled relationship.

In each of the embodiments referred to above the conventionally configured cylindrical main body of the hockey puck is formed by two identical half sections 10 and 12 in FIGS. 1, 4 and 5; and 10*a*, 12*a* in FIGS. 2 and 3 respectively. These half sections are preferably fabricated with innerfaces that are adapted to abut one another and that define at least three generally hemispherical cavities as indicated generally at 14 and 16 in FIG. 1. These hemispherical cavities are aligned with one another at assembly as suggested in FIG. 1 so that the hemispherically shaped cavities receive and trap three identical spherically shaped ball elements 18, 18 therein. Once these half sections have been so assembled, as shown for example in FIG. 4, the cylindrically shaped puck body portion has an axial dimension or depth D of at least approximately that provided in a conventional ice hockey puck. This dimension is preferably one inch and the diameter of the conventional hockey puck is approximately three inches. As clearly shown in FIG. 4 the ball elements 18, 18 have a diameter slightly larger than the depth D of the hockey puck so that diametrically opposed portions of the balls project beyond the outer faces of the cylindrical puck itself to provide rolling contact with a relatively rough dry surface of the type used in playing road hockey games. The preferred dimension for these ball elements 18, 18 is one and one-eighth inch but may be within the range of one-eighth to one-sixty-forth inch greater than the dimension D. As can be seen from FIG. 5 the ball elements 18, 18 are provided in spherical or hemispherical cavities 16, 16 that are only slightly larger than the diameters of the ball elements themselves. This assures that the balls are free to rotate in their respective cavities reducing the friction between the puck and the surface across which the puck is moved by a road hockey player. The term "semispherical" as used with reference to these cavities connotes a suitable bearing surface (14,16) for the spherical balls. If necessary to reduce friction these bearing surfaces could be relieved to reduce the area of contact between the ball and the "semispherical" surfaces.

Turning next to a more detailed description of the embodiment illustrated in FIGS. 2 and 3 the two half sections 10*a* and 12*a* of the cylindrical puck body portion are joined together by at least two and preferably three fasteners as indicated generally at 20, 20. The balls themselves are provided in equidistant circumaxially spaced relationship around the axis of the cylindrical puck body portion and the fastener elements 20 are preferably provided between the cavity defining portions provided for the ball elements 18, 18.

In the embodiment of FIGS. 1, 4 and 5 the puck body half sections are joined together preferably by a sonic welding process in the same areas as occupied by the screws 20, 20 of FIGS. 2 and 3.

Thus, the resulting road hockey puck has a size and shape similar to that of a coventional ice hockey puck but for the slight protrusion of the diameterically opposed ends of the spherical ball elements 18, 18. These ball elements preferably extend at least one-sixteenth of an inch beyond the outer faces of the cylindrical hockey puck body portion itself in the preferred embodiments described herein. Furthermore, the hemispherical cavities defined by these hockey puck body portions or sections have a common spherical center with the balls that are provided therein. For example, with a one inch high hockey puck a one and one-eighth inch ball geometry has been found to be satisfactory. With this geometry the hemispherical cavities preferably have a diameter only slightly greater than one and one-eighth inch. This geometry provides openings in the opposed outer faces of the hockey puck sections of approximately five eighths of an inch as illustrated generally at 22 in FIG. 2.

The preferred material for the puck body is polyurethane or other moldable plastic material of similar hardness. I prefer to coat the hemispherical cavities with VYDAX by Dupont or similar anti-frictional coating. The ball elements are preferably of nylon, delrin, polypropylene or polythelene and may also be coated with VYDAX by Dupont or equivalent.

Because these materials are somewhat lighter than those used in a conventional elastomic hockey puck some internal weighing may be necessary in the road hockey puck disclosed herein. We therefor provide internal cavities in the mating half sections to accommodate ballast weights (not shown) necessary to bring the puck's weight up to six ounces.

We claim:

1. A puck for playing road hockey and comprising:

a generally cylindrical main body, said body defined by at least two body sections, which sections are also of cylindrical configuration and include inner and outer faces, said inner faces abutting one another, said body sections having regions that define at least three spherical cavities, each cavity including semispherical portions formed in each of said body sections, spherical ball elements provided in said spherical cavities and including diametrically opposed projecting portions that protrude beyond the outer faces of said cylindrical body sections.

2. The puck of claim 1 wherein said cylindrical puck body has an axial thickness of dimension D, and wherein said spherical ball elements have a diameter of D plus delta where delta is in the range of one sixty-forth to one-eighth of an inch.

3. The puck of claim 2 wherein said spherical ball elements are of diameter one and one-eighth inch.

4. The puck of claim 3 wherein said semispherical cavities have a diameter approximately equal to that of said ball elements.

5. The puck of claim 1 further characterized by means for securing said cylindrical puck body sections to one another, said spherical ball elements provided in said spherical cavities solely by the restraint provided by said securing means.

6. The puck according to claim 5 wherein said puck body section securing means comprises sonic welded portions of said body sections between said cavity defining regions.

7. The puck of claim 1 wherein said dimension D is approximately one inch and wherein said cylindrical main body has a diameter of three inches, said body sections and said three ball elements having a combined weight of at least approximately six ounces to approximate the size and weight of a conventional ice hockey puck.

* * * * *